US009761198B2

(12) United States Patent
Huang et al.

(10) Patent No.: US 9,761,198 B2
(45) Date of Patent: Sep. 12, 2017

(54) DRIVING CIRCUIT FOR DRIVING COLOR DISPLAY TO DISPLAY BLACK-AND-WHITE/GRAYSCALE IMAGES AND DATA CONVERSION CIRCUIT THEREOF

(71) Applicant: SITRONIX TECHNOLOGY CORP., Hsinchu County (TW)

(72) Inventors: Jen-Fu Huang, Hsinchu County (TW); Jen-Chieh Liu, Hsinchu County (TW); I-Ting Chen, Hsinchu County (TW)

(73) Assignee: Sitronix Technology Corp., Hsinchu County (TW)

( * ) Notice: Subject to any disclaimer, the term of this patent is extended or adjusted under 35 U.S.C. 154(b) by 0 days.

(21) Appl. No.: 14/632,051

(22) Filed: Feb. 26, 2015

(65) Prior Publication Data

US 2015/0279315 A1 Oct. 1, 2015

Related U.S. Application Data

(60) Provisional application No. 61/971,049, filed on Mar. 27, 2014.

(51) Int. Cl.

| | |
|---|---|
| ***G09G 5/10*** | (2006.01) |
| ***G09G 5/02*** | (2006.01) |
| ***G09G 5/18*** | (2006.01) |

(52) U.S. Cl.

CPC ..... *G09G 5/02* (2013.01); *G09G 5/10* (2013.01); *G09G 5/18* (2013.01); *G09G 2340/0428* (2013.01); *G09G 2340/08* (2013.01)

(58) Field of Classification Search

CPC .. G09G 5/02; G09G 5/18; G09G 5/10; G09G 2340/0428; G09G 2340/08

See application file for complete search history.

(56) References Cited

U.S. PATENT DOCUMENTS 6,545,652 B1 * 4/2003 Tsuji ..... G09G 3/32 315/169.1

7,847,757 B2 12/2010 Urakami et al.

(Continued)

FOREIGN PATENT DOCUMENTS

| | | |
|---|---|---|
| CN | 1573908 A | 2/2005 |
| TW | I277044 B | 3/2007 |
| TW | 201007679 A | 2/2010 |

*Primary Examiner* — Towfiq Elahi

(74) *Attorney, Agent, or Firm* — Rosenberg, Klein & Lee

(57) ABSTRACT

The present invention provides a driving circuit for driving a color display to display black-and-white/grayscale images and comprises a data conversion circuit and a driver. The data conversion circuit receives input data transmitted by a microprocessor. The format of the input data is a black-and-white/grayscale format. The data conversion circuit converts the input data for producing output data. The format of the output data is a color format. The driver receives the output data and drives the color display to display the black-and-white/grayscale image. The driving circuit will convert the input data transmitted by the microprocessor with limited transmission capability and produce color output data for driving the color display to display the black-and-white/grayscale image. Accordingly, by using the driving circuit according to the present invention, an electronic device with limited transmission capability can work with the color display to display black-and-white/grayscale images.

8 Claims, 14 Drawing Sheets

(56) References Cited

U.S. PATENT DOCUMENTS

| | | | | |
|---|---|---|---|---|
| 2004/0119677 | A1* | 6/2004 | Nakamura | G09G 3/3208 345/89 |
| 2004/0165002 | A1 | 8/2004 | Honda et al. | |
| 2004/0174389 | A1* | 9/2004 | Ben-David | G09G 3/3413 345/694 |
| 2005/0024350 | A1* | 2/2005 | Kamiyamaguchi | G09G 3/2025 345/204 |
| 2005/0052386 | A1* | 3/2005 | Kwon | G09G 3/3648 345/87 |
| 2012/0242682 | A1* | 9/2012 | Nanjo | G09G 5/02 345/601 |

* cited by examiner

DRIVING CIRCUIT FOR DRIVING COLOR DISPLAY TO DISPLAY BLACK-AND-WHITE/GRAYSCALE IMAGES AND DATA CONVERSION CIRCUIT THEREOF

FIELD OF THE INVENTION

The present invention relates generally to a driving circuit for display, and particularly to a driving circuit that receives input data in the black-and-white/grayscale format for displaying black-and-white/grayscale images on a color display and a data conversion circuit thereof.

BACKGROUND OF THE INVENTION

Modern technologies are developing prosperously. Most electronic devices, for example, indoor telephones, fax machines, printers, mobile phones, tablet computers, and billboards, include a display. Because the text and images shown in color are pleasing to the eye, color displaying has become the mainstream in the development of display technology. Nonetheless, some electronic devices still adopt black-and-white/grayscale displaying method for displaying text or image information presently. Color displaying is the current mainstream, thereby the demand for color displays is huge. The manufacturing technology of color displays has improved substantially in the present day. Thanks to mass production, the manufacturing cost of color displays has reduced, lowering their street price accordingly. Compared with color displays, black-and-white/grayscale displays have fewer market demands. Thereby, the prices of black-and-white/grayscale displays are higher than those of color displays.

Based on the reasons as described above and the consideration for costs, many electronic manufacturers hope to change the black-and-white/grayscale displays on electronic devices to color ones for displaying black-and-white/gray scale images as well. Nonetheless, the microcontrollers of some electronic devices are low-end microprocessors with limited transmission capability only affordable for transmitting black-and-white/grayscale image data having small data quantity. Low-end microprocessors need longer time for transmitting color image data having large data quantity. For color displays, the transmission rate for color image data by low-end microprocessors is too slow, leading to slow image displaying rate and inferior displaying quality. In order to solve the problem, low-end microprocessors should be replaced by high-end ones, which further increases the overall cost of electronic devices.

Accordingly, the present invention provides a driving circuit, which receives black-and-white/grayscale input data and produces color output data according the black-and-white/grayscale input data for driving a color display to display black-and-white/grayscale images. Thereby, the above problem according to the prior art can be solved.

SUMMARY

An objective of the present invention is to provide a driving circuit, which converts black-and-white/grayscale input data and produces color output data for driving a color display to display black-and-white/grayscale images.

Another objective of the present invention is to provide a data conversion circuit, which converts black-and-white/grayscale input data and produces color output data for the driving circuit of a color display. Then the driving circuit can drive the color display to display black-and-white/grayscale images accordingly.

The present invention discloses a driving circuit for driving a color display to display black-and-white/grayscale images and comprises a data conversion circuit and a driver. The data conversion circuit receives input data transmitted by a microprocessor. The format of the input data is a black-and-white/grayscale format. The input data correspond to a black-and-white/grayscale image. The data conversion circuit converts the input data for producing output data. The format of the output data is a color format. The number of bits of the input data is less than that of the output data. The driver receives the output data and drives a color display according to the output data for displaying the black-and-white/grayscale image.

The present invention discloses a data conversion circuit in the driving circuit of a color display. The data conversion circuit receives input data transmitted by a microprocessor. The format of the input data is a black-and-white/grayscale format. The input data correspond to a black-and-white/grayscale image. The data conversion circuit comprises a separation unit, an adjustment unit, and a clock generator. The separation unit receives and separates the input data for outputting a plurality of basic pixel data in a black-and-white/grayscale format. The adjustment unit receives the plurality of basic pixel data and produces output data according to the plurality of basic pixel data. The format of the output data is a color format. The output data include a plurality of display pixel data in the color format. The number of bits of each of the display pixel data is greater than that of each of the basic pixel data. The clock generator generates a clock signal. A plurality of pulses of the clock signal correspond to the plurality of display pixel data of the output data. The color display displays a plurality of black-and-white/grayscale pixels according to the plurality of display pixel data of the output data for displaying the black-and-white/grayscale image.

DETAILED DESCRIPTION

In order to make the structure and characteristics as well as the effectiveness of the present invention to be further understood and recognized, the detailed description of the present invention is provided as follows along with embodiments and accompanying figures.

Figure 1:
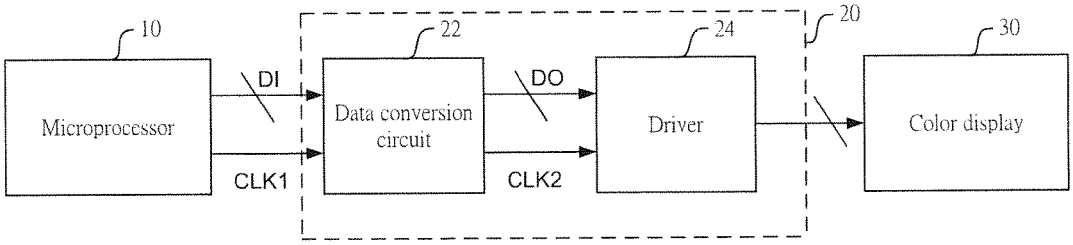
FIG. 1 shows a block diagram of the driving circuit for a color display according to an embodiment of the present invention.

Please refer to FIG. 1, which shows a block diagram of the driving circuit for a color display according to an embodiment of the present invention. As shown in the figure, the driving circuit 20 according to the present invention is coupled to microprocessor 10 and a color display 30. The microprocessor 10 transmits black-and-white/grayscale input data DI and a clock signal CLK1 to the driving circuit 20. The input data DI are used for displaying a black-and-white/grayscale image. The driving circuit 20 according to the present invention comprises a data conversion circuit 22 and a driver 24. The data conversion circuit 22 is coupled to the microprocessor 10. The data conversion circuit 22 receives the input data DI and the clock signal CLK1, converts the input data DI for producing color output data DO, and generates a clock signal CLK2 according to the clock signal CLK1. The driver 24 is used for driving the color display 30 and coupled to the data conversion circuit 22 and the color display 30. The driver 24 receives the output data DO and the clock signal CLK2 and drives the color display 30 to display the black-and-white/grayscale image according to the output data DO.

Because the data format for driving the color display 30 must be in color format, the data conversion circuit 22 of the driving circuit 20 according to the present invention converts the black-and-white/grayscale input data DI for producing the color output data DO. Thereby, the driver 24 can drive the color display 30 according to the color output data DO for displaying the black-and-white/grayscale image. According to the above description, the driving circuit 20 according to the present invention can convert the black-and-white/grayscale input data DI for producing the color output data DO and thus driving the color display 30. Consequently, even if the microprocessor 10 is a low-end one with limited transmission capability, the driving circuit 20 according to the present invention still can drive the color display 30 according to the black-and-white/grayscale input data DI. Hence, an electronic device with limited transmission capability can display black-and-white/grayscale images on the color display 30 by using the driving circuit 20. In the following, examples are provided for describing how the data conversion circuit 22 converts the black-and-white/grayscale input data DI for producing the color output data DO.

Figure 2A:
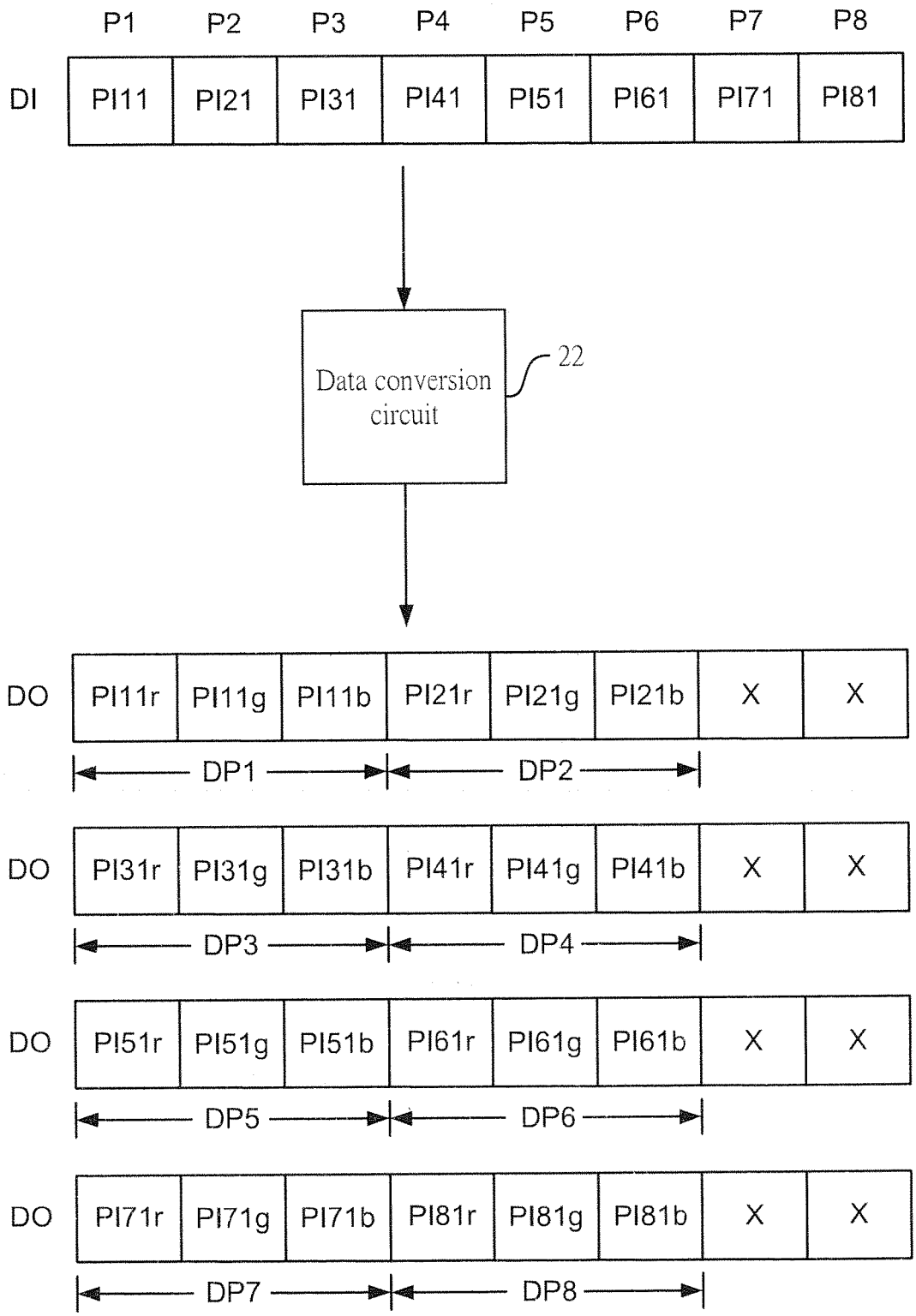
FIG. 2A shows a schematic diagram of the data conversion circuit converting input data in 2-level grayscale format for producing output data according to an embodiment.

Please refer to FIG. 2A, which shows a schematic diagram of the data conversion circuit 22 converting input data DI for producing output data DO according to a first embodiment. The format of the input data DI according to the present embodiment is 2-level gray scale. As shown in FIG. 1, the microprocessor 10 transmits one byte of input data DI, which contains 8 data bits PI11, PI21, PI31, PI41, PI51, PI61, PI71, PI81. Because the format of the input data DI is 2-level gray scale, each data bit is a pixel datum representing a black-and-white/grayscale pixel. Thereby, the pixel data PI11~PI81 represent 8 black-and-white/grayscale pixels P1~P8 in the black-and-white/grayscale image. Color image data include red data (R), green data (G), and blue data (B). Accordingly, the data amount of a color image is three times as large as that of the input data DI. Hence, the data conversion circuit 22 receives and reproduces the input data DI for producing the color output data DO.

According to the present embodiment, the data conversion circuit 22 reproduces each of the pixel data PI11~PI181 of the input data DI. Each of the pixel data PI11~PI81 is reproduced individually. The data conversion circuit 22 will reproduce a pixel datum and produce three color data as R, G, B data. As shown in the figure, the data conversion circuit 22 reproduces the pixel datum PI11 and produces three color data PI11*r*, PI11*g*, and PI11*h*, which are identical to the pixel datum PI11. Likewise, the data conversion circuit 22 will reproduce the pixel data PI21~PI81, respectively, for producing color data corresponding to the pixel data PI21~PI81. Each of the pixel data PI21~PI81 will be reproduced, respectively, giving three color data. In addition, the "X" in FIG. 2A means the don't-care item in logic. Accordingly, the data conversion circuit 22 can produce the color output data DO.

As shown in the figure, the output data DO correspond to the input data DI and contain 8 display pixel data DP1~DP8, which is used for displaying 8 black-and-white/grayscale pixels P1~P8. The plurality of display pixel data DP1~DP8 all include R, G, and B data. According to the present embodiment, the plurality of display pixel data DP1~DP8 of the output data DO correspond to the plurality of pixel data PI11~PI81 of the input data DI and contain R, G, B data, respectively. For example, the display pixel datum DP1 of the output data DO corresponds to the pixel datum PI11 of the input data DI; the display pixel datum contains color data PI11*r* (R datum), PI11*g* (G datum), and PI11*b* (B datum). In other words, the R, G, B data in the pixel datum DPI are identical to the pixel datum PI11. Likewise, the R, G, B data of the plurality of display pixel data DP2~DP8 in the output data DO are identical to the plurality of pixel data PI21~PI81 in the input data DI.

Figure 2B:
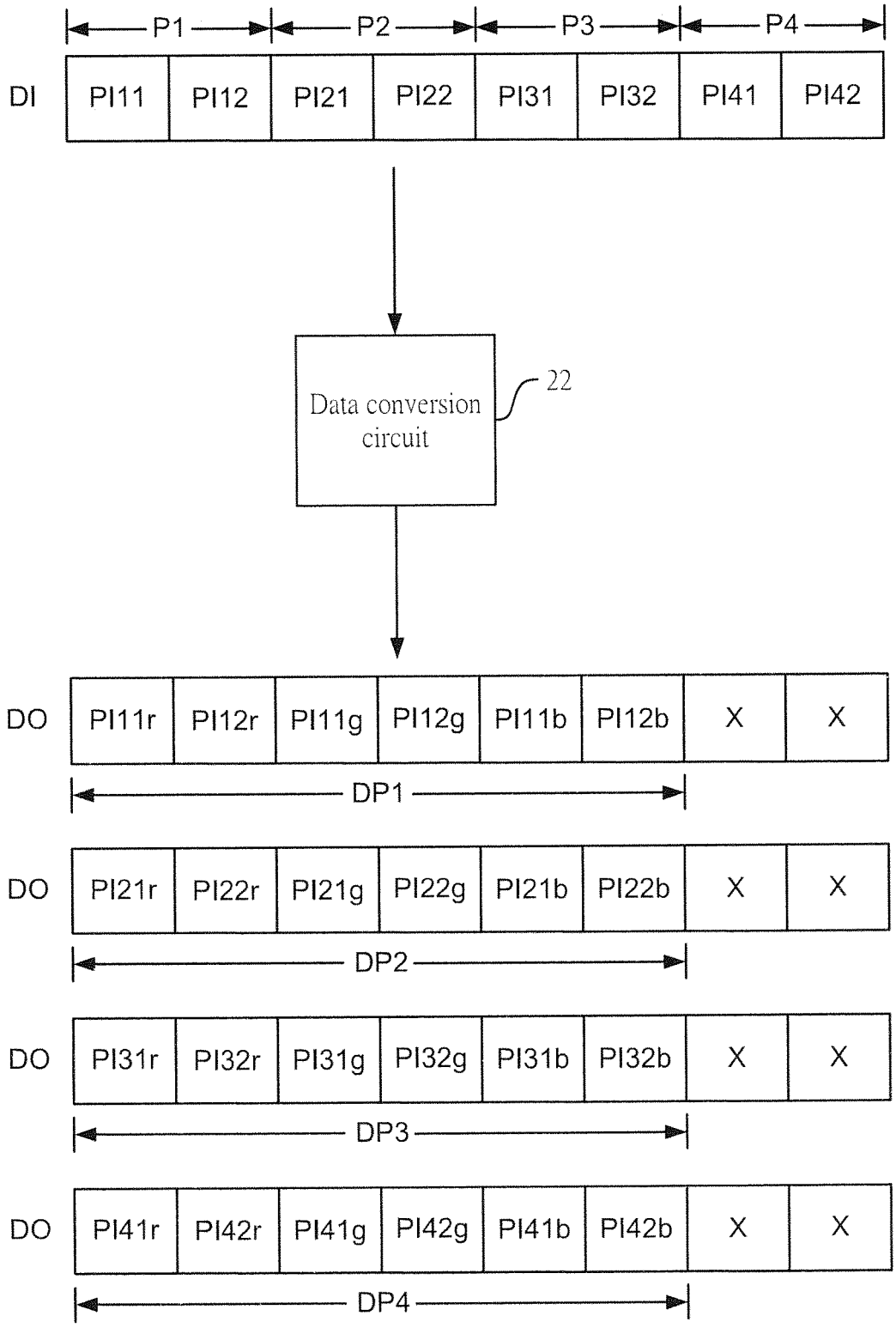
FIG. 2B shows a schematic diagram of the data conversion circuit converting input data in 4-level grayscale format for producing output data according to an embodiment.

Please refer to FIG. 2B, which shows a schematic diagram of the data conversion circuit 22 converting input data DI for producing output data DO according to a second embodiment. The format of the input data DI according to the present embodiment is 4-level gray scale. As shown in the figure, the microprocessor 10 transmits one byte of input data DI, which contains 8 data bits PI11, P12, PI21, PI22, PI31, PI32, PI41, PI42. Because the format of the input data DI is 4-level gray scale, two data bits form a pixel datum representing a black-and-white/grayscale pixel. Thereby, the 8 pixel data PI11, P12, PI21, PI22, PI31, PI32, PI41, PI42 represent 4 black-and-white/grayscale pixels P1~P4 in the black-and-white/grayscale image.

The data conversion circuit 22 reproduces the pixel data PI11, P12, PI21, PI22, PI31, PI32, PI41, PI42. Each pixel datum of reproduced to give three color data and form the output data DO. According to the present embodiment, the output data DO correspond to the input data DI and contain 4 display pixel data DP1, DP2, DP3, DP4 used for displaying 4 black-and-white/grayscale pixels P1~P4. The display pixel datum DPI corresponds to the pixel data PI11, PI12; the display pixel datum DP2 corresponds to the pixel data PI21, PI22; the display pixel datum DP3 corresponds to the pixel data PI31, PI32; the display pixel datum DP4 corresponds to the pixel data PI41, PI42. The plurality of pixel data DP1~DP4 contain color data (R, G, B data). respectively.

Figure 2C:
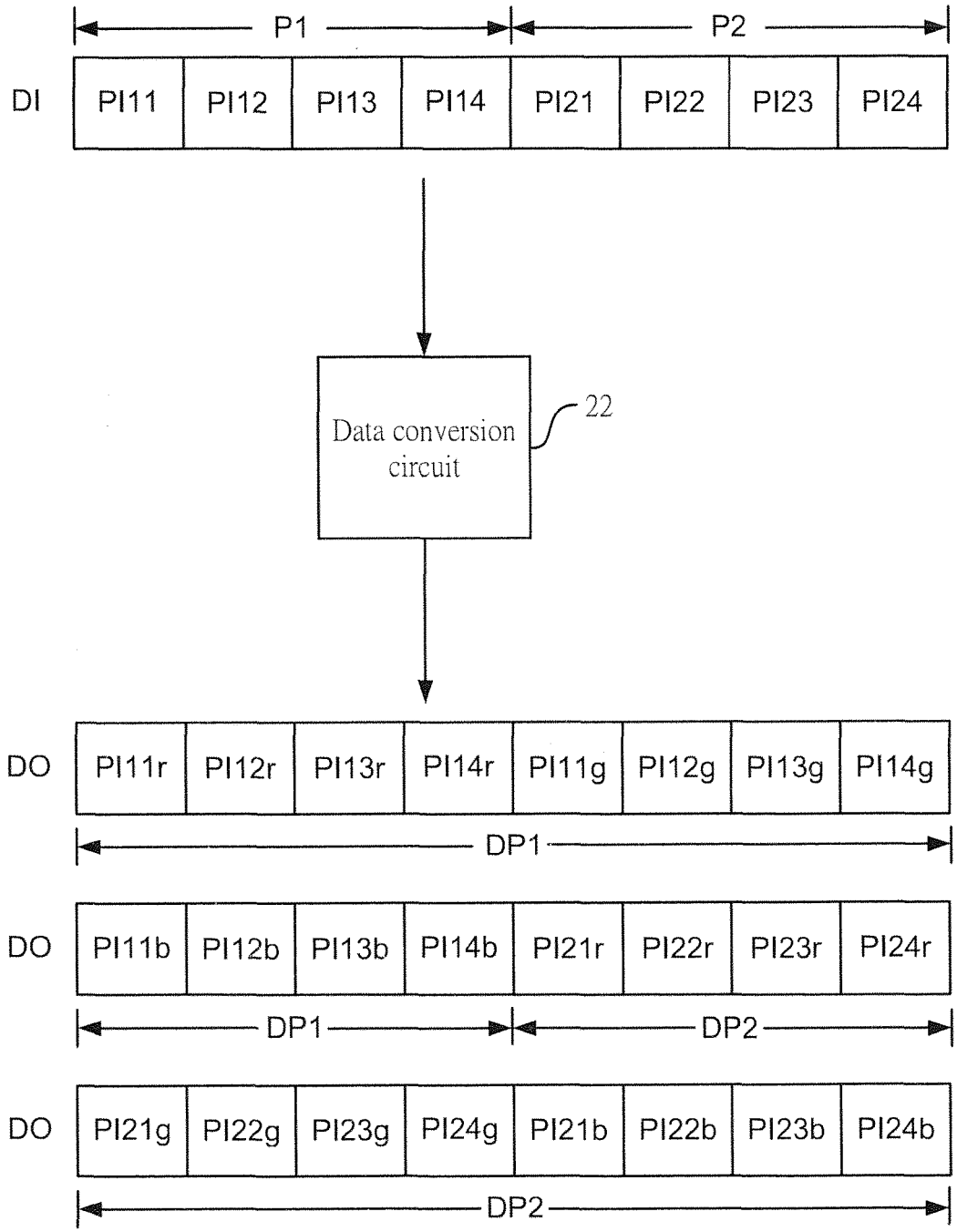
FIG. 2C shows a schematic diagram of the data conversion circuit converting input data in 16-level grayscale format for producing output data according to an embodiment.

Please refer to FIG. 2C, which shows a schematic diagram of the data conversion circuit 22 converting input data DI for producing output data DO according to a third embodiment. The format of the input data DI according to the present embodiment is 16-level gray scale. As shown in the figure, the microprocessor 10 transmits one byte of input data DI, which contains 8 data bits PI11, P12, P13, P14, PI21, PI22, PI23, PI24. Because the format of the input data DI is 16-level gray scale, four data bits form a pixel datum representing a black-and-white/grayscale pixel. Thereby, the 8 pixel data PI11, P12, P13, P14, PI21, PI22, PI23, PI24 represent 2 black-and-white/grayscale pixels P1, P2 in the black-and-white/grayscale image. The data conversion circuit 22 reproduces the pixel data PI11~P14 and PI11~PI24, respectively, for producing the color output data DO. According to the present embodiment, the output data DO correspond to the input data DI and contain 2 display pixel data DP1. DP2 used for displaying 2 black-and-white/grayscale pixels P1, P2. The plurality of pixel data DP1, DP2 contain color data, respectively.

Figure 2D:
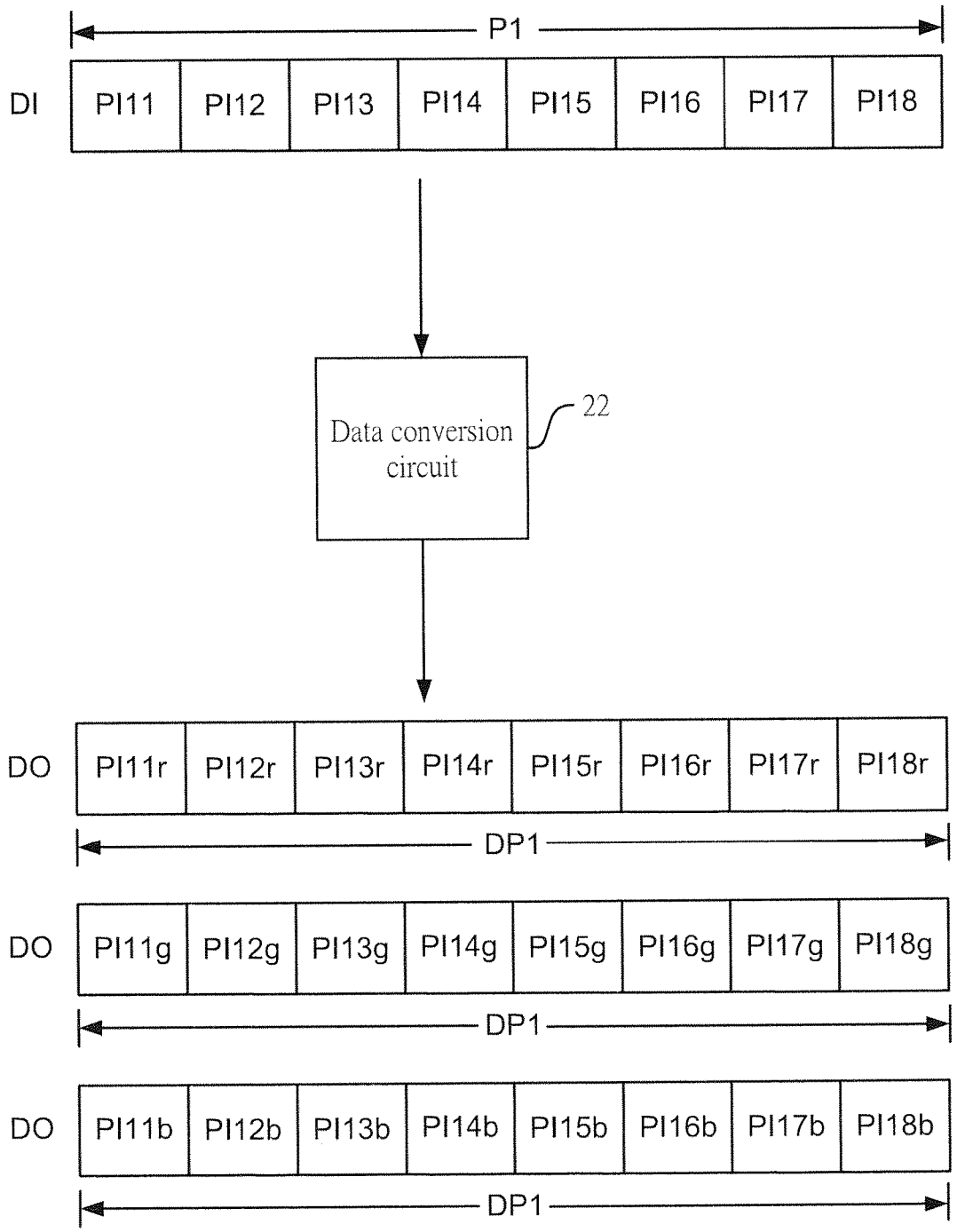
FIG. 2D shows a schematic diagram of the data conversion circuit converting input data in 256-level grayscale format for producing output data according to an embodiment.

Please refer to FIG. 2D, which shows a schematic diagram of the data conversion circuit 22 converting input data DI for producing output data DO according to a fourth embodiment. The format of the input data DI according to the present embodiment is 256-level gray scale. As shown in the figure, the microprocessor 10 transmits one byte of input data DI, which contains 8 data bits PI11, P12, P13, P14, PI15, PI16, PI17, PI18. Because the format of the input data DI is 256-level gray scale, eight data bits form a pixel datum representing a black-and-white/grayscale pixel. Thereby, the 8 pixel data PI11, P12, P13, P14, PI15, PI16, PI17, PI18 represent one black-and-white/grayscale pixels PI in the black-and-white/grayscale image. The data conversion circuit 22 reproduces the pixel data PI11~P18, respectively, for producing the color output data DO. According to the present embodiment, the output data DO correspond to the input data DI and, contain one display pixel datum DP1 used for displaying one black-and-white/grayscale pixel P1. The pixel datum DP1 contains color data.

Figure 3:
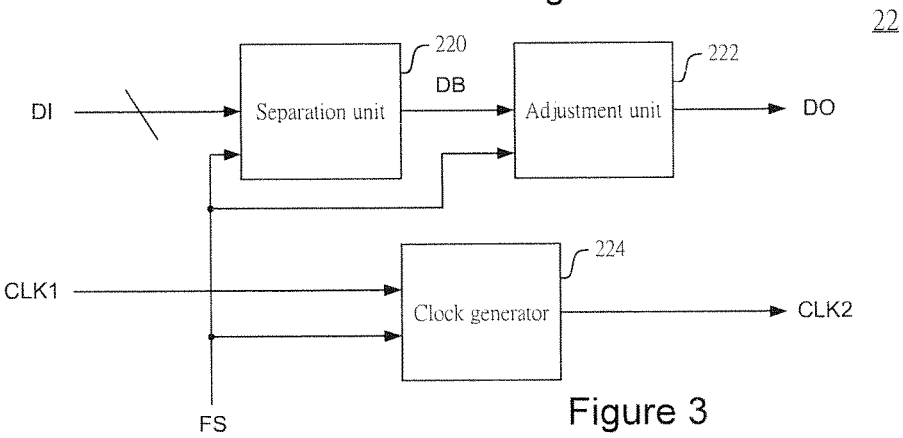
FIG. 3 shows a block diagram of the data conversion circuit according to an embodiment of the present invention.
Figure 4A:
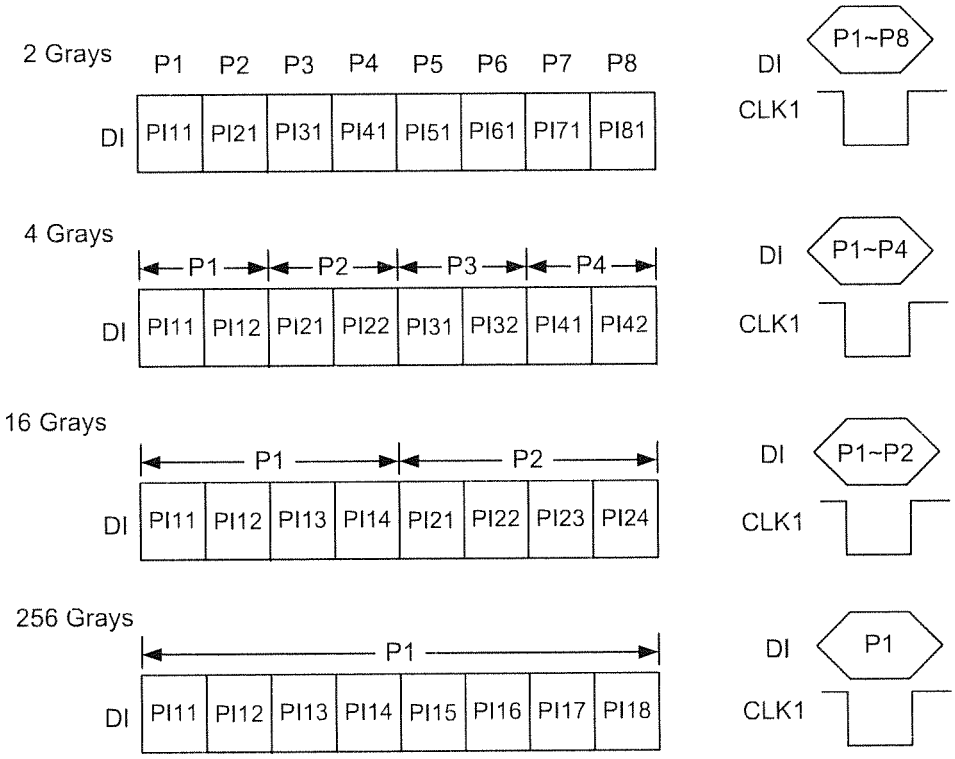
FIGS. 4A to 4D show schematic diagrams of the data conversion circuit converting input data for producing output data according to an embodiment.

Please refer to FIG. 3, which shows a block diagram of the data conversion circuit according to an embodiment of the present invention. As shown in the figure, the microprocessor 10 transmits the input data DI to the data conversion circuit 22 according to the clock signal CLK1. According to the present embodiment, the microprocessor 10 transmits one byte of the input data DI. As shown in FIG. 4A, the microprocessor 10 transmits one byte of the input data DI according to a pulse of the clock signal CLK1. If the format of the input data DI is 2-level gray scale, the 8 data bits PI11~PI81 contained in the input data DI represent 8 black-and-white/grayscale pixels P1~P8. If the format of the input data DI is 4-level gray scale, the 8 data bits PI11, PI12, PI21, PI22, PI31, PI32, PI41, PI42 contained in the input data DI represent 4 black-and-white/grayscale pixels P1, P4. If the format of the input data DI is 16-level gray scale, the 8 data bits PI11~PI14 and PI21~PI24 contained in the input data DI represent 2 black-and-white/grayscale pixels P1, P2. If the format of the input data DI is 256-level gray scale, the 8 data bits PI11~PI18 contained in the input data DI represent one black-and-white/grayscale pixel P1.

Please refer again to FIG. 3. The data conversion circuit 22 comprises a separation unit 220, an adjustment unit 222, and a clock generator 224. The separation unit 220 receives a format selecting signal FS and the input data DI transmitted by the microprocessor 10. The format selecting signal FS represents the gray scale of the input data DI, such as 2-, 4-, 16-, 64-, or 256-level gray scale. The separation unit 220 separates the input data DI according to the format selecting signal FS and outputs a plurality of basic pixel data DB. Because the format of the input data DI is a black-and-white/grayscale format, the format of the plurality of basic pixel data DB is black-and-white/grayscale as well. According to an embodiment of the present invention, the format selecting signal FS as described above is set by the user according to the usage requirement. Alternatively, the selecting parameters can be predetermined in the data conversion circuit 22 according to the grayscale format of the input data DI.

Figure 4B:
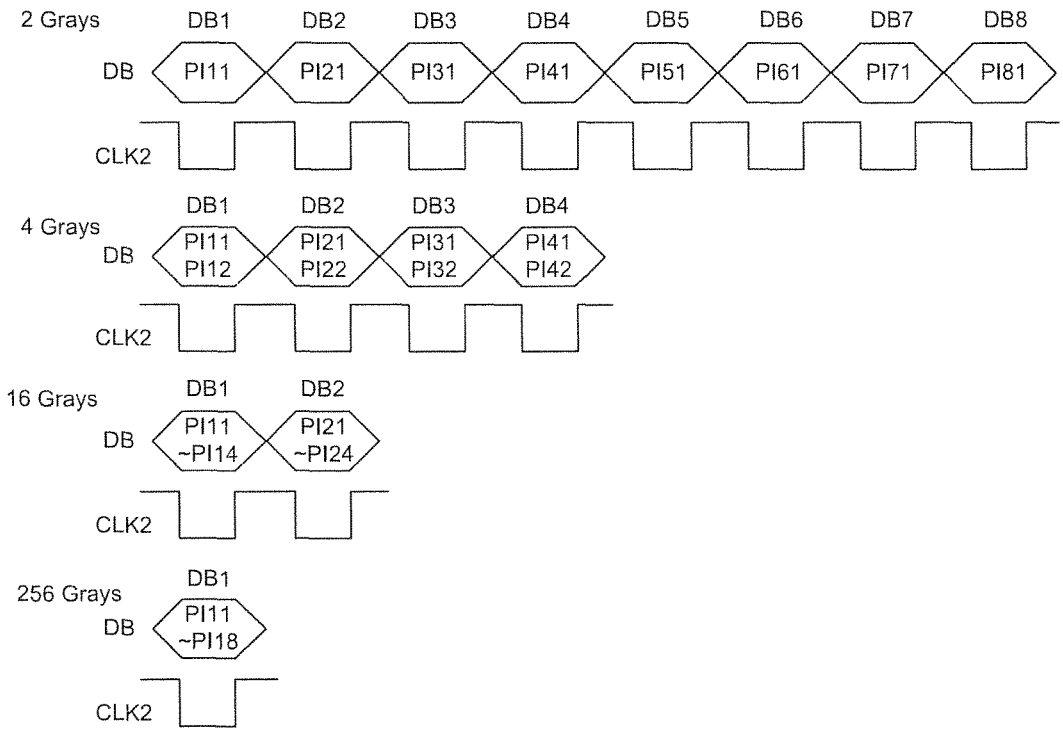

As shown in FIGS. 4A and 4B, the separation unit 220 takes a black-and-white/grayscale pixel as the unit of separation for separating the input data DI and outputting the plurality of basic pixel data DB. If the format of the input data DI is 2-level gray scale, the separation unit 220 uses a data bit as the unit for separating the 8 data bits PI11~PI81 of the input data DI and producing the basic pixel data DB1~DB8, which correspond to PI11~PI81, respectively. If the format of the input data DI is 4-level gray scale, the separation unit 220 uses two data bits as the unit for separating the 8 data bits PI11~PI12, PI21~PI22, PI31~PI32, PI41~PI42 of the input data DI and producing the basic pixel data DB1~DB4, which correspond to data bits (PI11 and PI12), (PI21 and PI22), (PI31 and PI32), and (PI41 and PI4), respectively. If the format of the input data DI is 16-level gray scale, the separation unit 220 separates the 8 data bits PI11~PI14 and PI21~PI24 of the input data DI and produces the basic pixel data DB1~DB2. If the format of the input data DI is 256-level gray scale, the separation unit 220 separates the 8 data bits PI11~PI18 of the input data DI and produces the basic pixel data DB1.

Please refer again to FIG. 3. The clock generator 224 receives the format selecting signal FS and generates the clock signal CLK2 according to the format selecting signal FS. The pulses of the clock signal CLK2 correspond to the basic pixel data DB. As shown in FIG. 4B, if the format of the input data DI is 2-level gray scale, the clock signal CLK2 generated by the clock generator 224 includes 8 pulses in a cycle corresponding to the basic pixel data DB1~DB8, respectively. Likewise, if the format of the input data DI is 4-level gray scale, the clock signal CLK2 generated by the clock generator 224 includes 4 pulses in a cycle. If the format of the input data DI is 16-level gray scale, the clock signal CLK2 generated by the clock generator 224 includes 2 pulses. If the format of the input data DI is 256-level gray scale, the clock signal CLK2 generated by the clock generator 224 includes one pulse. According to an embodiment of the present invention, the clock generator 224 receives the clock signal CLK1 transmitted by the microprocessor 10 and generates the clock signal CLK2 according to the clock signal CLK1. The clock generator 224 can generate the clock signal CLK2 by many methods. The generation of the clock signal CLK2 is not necessarily according to the clock signal CLK1 only.

Figure 4C:
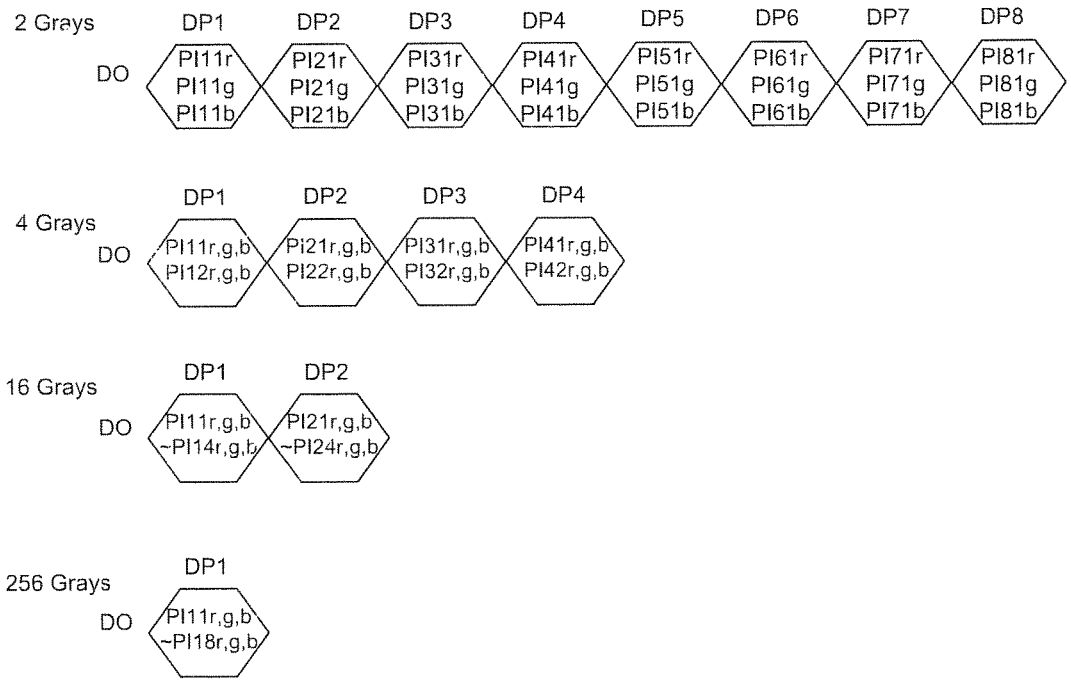

Please refer again to FIG. 3. The adjustment unit 222 is coupled to the separation unit 220 for receiving the basic pixel data DB. The adjustment unit 222 further receives the format selecting signal FS. The adjustment unit 222 is used for producing the output data DO according to the format selecting signal FS and the basic pixel data DB. The output data DO include a plurality of display pixel data corresponding to the plurality of basic pixel data, respectively. Besides, each of the display pixel data includes color data (R, G, G data). Thereby, the format of the display pixel data is a color format. As shown in FIG. 4C, if the format of the input data DI is 2-level scale, the output data include the display pixel data DP1~DP8 each including color data. For example, the display pixel datum DPI includes color data PI11*r* (R datum), PI11*g* (G datum), and PI11*b* (B datum); the display pixel datum DP2 includes color data PI21*r* (R datum), PI21*g* (G datum), and PI21*b* (B datum).

The adjustment unit 222 reproduces the basic pixel data DB to give the plurality of color'data. For example, if the format of the input data DI is 2-level gray scale, the adjustment unit 222 reproduces the basic pixel data DP1~DP8, respectively, and gives the plurality of display pixel data DP1~DP8. As shown in FIG. 4C, the adjustment unit 222 reproduces the basic pixel datum DB1 (PI11) and gives three color data, which are just the color data PI11*r*, PI11*g*, and PI11*b* of the display pixel datum DP1. The values of the color data PI11*r*, PI11*g*, and PI11*b* are identical to that of the basic pixel datum DB1 (PI11). According to the above description. the number of bits of the display pixel datum DPI is three times as many as that of the basic pixel datum DB1. Likewise, the color data of the display pixel data DP2~DP8 are identical to the basic pixel data DB2~DB8, respectively. Thereby, the format of the output data DO is a color format.

Please refer to FIG. 4C. If the format of the input data DI is 4-level gray scale, the adjustment unit 222 reproduces the basic pixel data DB1~DB4, respectively, and gives the plurality of display pixel data DP1~DP4. Because each of the color data in each of the basic pixel data DB1~DB4 contains two data bits, each of the color data in each of the display pixel data DP1~DP4 contains two data bits. For example, the adjustment unit 222 reproduces the data bits PI11 and PI12 of the basic pixel datum DB1 and gives three color data PI11*r*-PI12*r* (R data), PI11*g*-PI12*g* (G data), PI11*b*-PI12*b* (B data).

Similar to the above description, if the format of the input data DI is 16-level gray scale, the adjustment unit 222 reproduces the basic pixel data DB1~DB2, respectively, and gives the plurality of display pixel data DP1~DP2. Because each of the color data in each of the basic pixel data DB1~DB2 contains four data bits, each of the color data in each of the display pixel data DP1~DP2 contains four data bits. For example, the adjustment unit 222 reproduces the data bits PI11~PI14 of the basic pixel datum DB1 and gives three color data PI11*r*~PI14*r* (R data), PI11*g*~PI14*g* (G data), PI11*b*~PI124 (B data). Likewise, if the format of the input data DI is 256-level gray scale, the adjustment unit 222 reproduces the basic pixel data DB1 and gives the display pixel data DPI. Each of the color data in the display pixel data DPI contains 8 data bits.

Figure 4D:
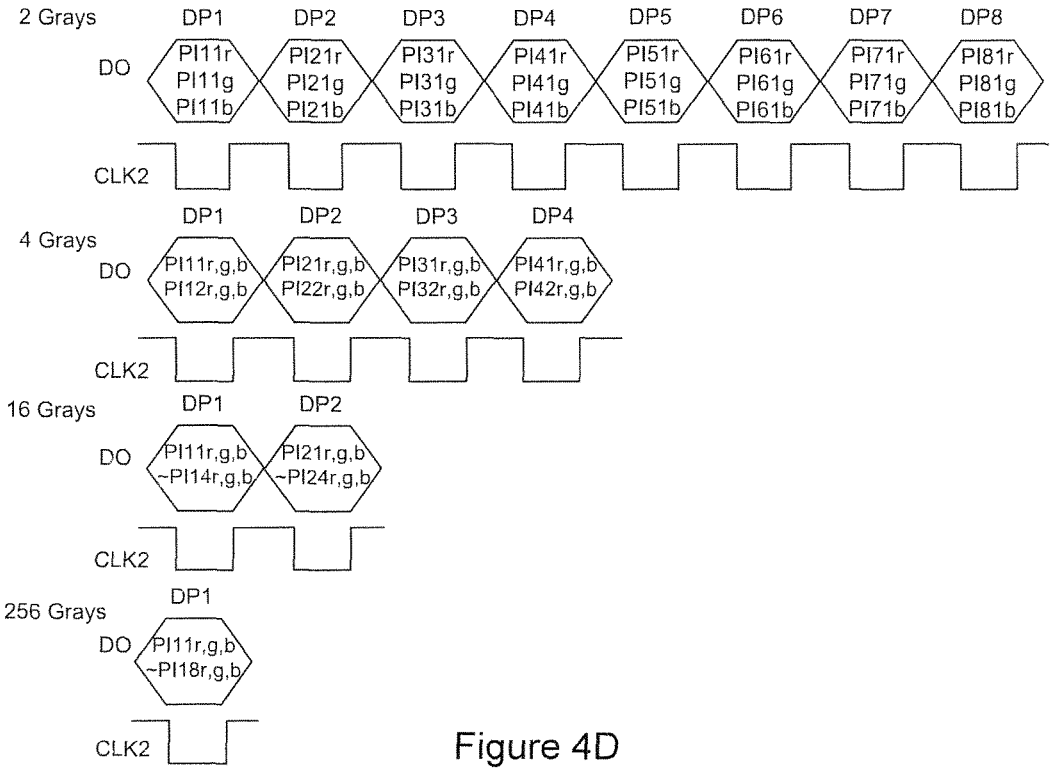

Please refer again to FIG. 3 and FIG. 4D. After the adjustment unit 222 produces the output data DO, it will output the output data DO to the driver 24, as shown in FIG. 1. At this moment, the clock generator 224 will also output the clock signal CLK2 to the driver 24. The driver 24 drives the color display 30 to display black-and-white/grayscale pixels according to the display pixel data DP of the output data DO for displaying the black-and-white/grayscale image. As shown in FIG. 4D, the pulses of the clock signal CLK2 correspond to the display pixel data DP of the output data DO. In other words, the number of the pulses of the clock signal CLK2 is identical to the number of the display pixel data DP.

According to the above description, the driving circuit 20 according to the present invention can convert the black-and-white/grayscale input data DI and produce the color output data DO for driving the color display 30 to display black-and-white/gray scale pixels. Thereby, the microprocessor 10 only needs to transmit small image data in black-and-white/grayscale format. The driving circuit for color display according to the prior art has to receive color input data before it can drive a color display. Hence, the data amount transmitted by the microprocessor in the driving circuit according to the prior art is three times as large as that transmitted by the microprocessor 10 according to the prior art. For example, if the resolution of the color display is 320*240 with 16-level gray scale, it means that the color display has 76800 pixels with each pixel displaying 16-level gray scale. As shown in FIG. 4A, if the format of the input data DI is 16-level gray scale, one byte of data can represent two pixels. Thereby, the data amount of the input data DI transmitted by the microprocessor 10 according to the present invention 10 is 38400 bytes, as calculated by:

$$(320*\ 240/2)*\ 1=38400$$

Nonetheless; the driving circuit according to the prior art needs to receive data in color format before it can drive a color display. Thereby, the format of the data transmitted by the microprocessor in the driving circuit according to the prior art has to be a color format. The data transmitted by the microprocessor should include color data (R, G, B), If the display format of the pixels is 16-level gray scale, it means that a color datum contains four bits. Thereby, the three color data R, G, B require 12 bits. That is to say, it takes 12 bits of pixel data to display a pixel in color format. Then, it takes three bytes of data to represent two pixels. Accordingly, the data amount of the data transmitted by the microprocessor in the driving circuit according to the prior art is 115200 bytes, as calculated by:

$$(320*240/2)*3=115200$$

According to the above description, the data amount transmitted by the microprocessor in the driving circuit according to the prior art is three times as large as that transmitted by the microprocessor 10 according to the present invention. Accordingly, by applying the driving circuit 20 according to the present invention, no high-transmission-rate microprocessor is required for driving a color display to display black-and-white/grayscale images.

Figure 5A:
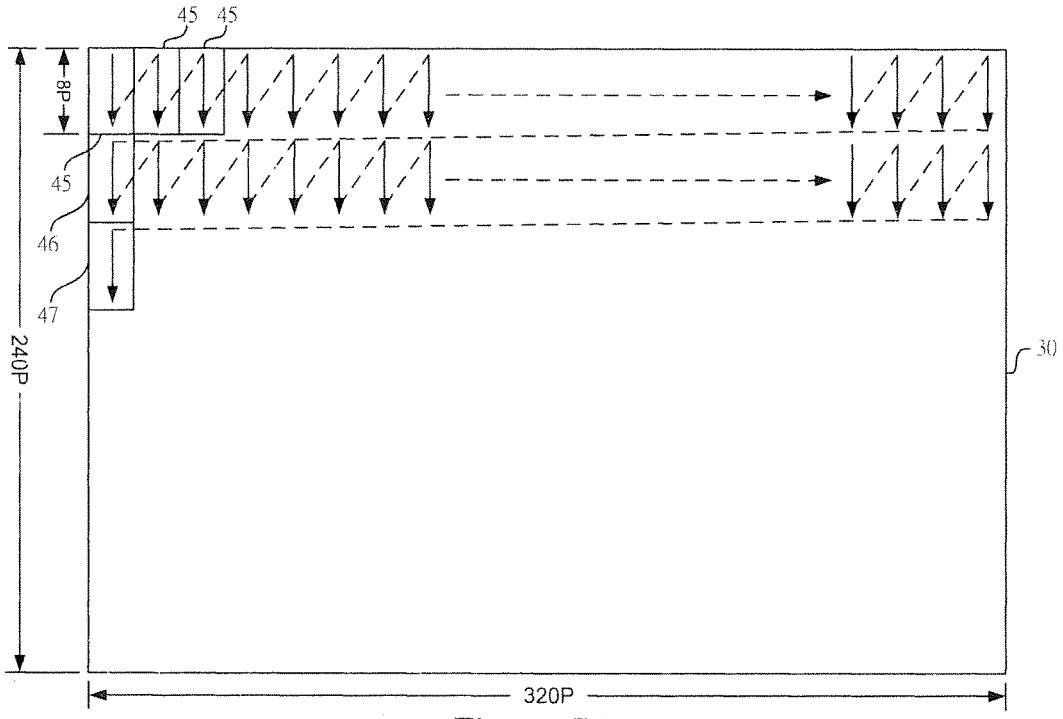
FIG. 5A shows a schematic diagram of a color display displaying a black-and-white/grayscale image according to the first embodiment of the present invention.
Figure 5B:
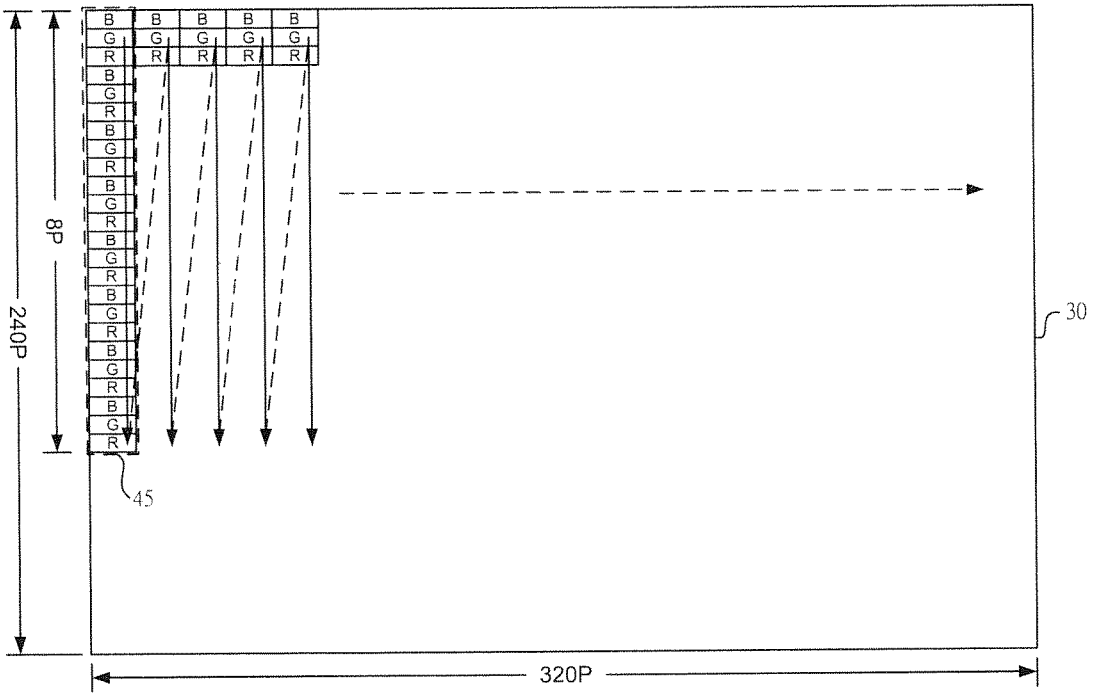
FIG. 5B shows an enlarged diagram of FIG. 5A.

Please refer to FIG. 5A and FIG. 5B. which show a schematic diagram and an enlarged diagram of a color display displaying a black-and-white/grayscale image according to the first embodiment of the present invention. The display of the electronic device, such as an indoor phone, a fax machine, and a printer, for displaying black-and-white/grayscale information is disposed in, landscape. As shown in FIGS. 5A and 5B, the color display 30 according to the present invention is disposed in landscape. Nonetheless, the disposition of the color display 30 is not limited to landscape position only. FIGS. 5A and 5B show the order of the driving circuit 20, as shown in FIG. 1, driving a plurality of black-and-white/grayscale pixels of the color display 30 for displaying black-and-white/grayscale images. According to the present embodiment, the resolution of the color display 30 is 320*240 (320P*240P), which means that the color display 30 has 76800 pixels. Namely, the color display 30 includes 76800 black-and-white/grayscale pixels for displaying black-and-white/grayscale images. In addition, a black-and-white/grayscale image includes 320 vertical column images. Each vertical column image includes 240 black-and-white/grayscale pixels. The above description is only an embodiment of the present invention. The resolution of the color display 30 is not limited to 320*240.

The driver 24 of the driving circuit 20 according to the present invention as shown in FIG. 1 drives the color display 30 to display black-and-white/grayscale images according to a display parameter and the output data. The display parameter is preset in the driver 24. Alternatively, the user transmits it to the driver 24 by a command. The driver 24 determines the order for displaying the plurality of black-and-white/grayscale pixels of a black-and-white/grayscale image on the color display 30 according to the display parameter. The display parameter corresponds to the grayscale level of the input data, for example, 2-level, 4-level, 16-level, 64-level, or 256-level gray scale. In the following, FIGS. 5A and 5B are taken as an example for describing the order by which the color display 30 displays black-and-white/grayscale images. The format of the input data according to the present embodiment is 2-level gray scale. Thereby, one byte of input data contains 8 pixel data and represents 8 black-and-white/grayscale pixels. The display parameter according to the present embodiment is the parameter corresponding to 2-level gray scale. The data conversion circuit 22 of the driving circuit 20, as shown in FIG. 1, converts the input data and produces the color output data. The driver 24 of the driving circuit 20 drives the color display 30 to display black-and-white/grayscale image according to the output data and the display parameter.

As shown in FIG. 5A, the driver 24 drives the color display 30 to display each vertical column image sequentially. The method by which the color display 30 displays the vertical column image is segmented displaying. According to the present embodiment, because the format of the input data is 2-level gray scale and one byte of the input data represents 8 black-and-white/grayscale pixels, the driver 24 drives the color display 30 to display 8 black-and-white/grayscale pixels (8P) each time. The 8 black-and-white/grayscale pixels form an image segment determined by the driver 24 according to the display parameter. According to the present embodiment, each vertical column image contains 240 black-and-white/grayscale pixels and each image segment contains 8 black-and-white/grayscale pixels. Thereby, each individual vertical column image contains 30 image segments.

As shown in FIGS. 5A and 58, the driver 24 initially drives the color display 30 to display the first image segment of each vertical column image sequentially. After the first image segments 45 of the 320 vertical column images are displayed, following the first image segment 45 of each vertical column image displayed in advance, the color display 30 displays the second image segment 46 of each vertical column image sequentially. Afterwards, the third image segment 47 of each vertical column image is displayed until the last image segment of each vertical column image. Then, a black-and-white/grayscale image is displayed completely.

According to the above description, each vertical column image of the color display 30 has P black-and-white/grayscale pixels, where P is greater than zero and each vertical column image contains a plurality of image segments. Besides, each image segment contains Q black-and-white/grayscale pixels, where Q is greater than zero and small& than P. The driving circuit 20 drives the color display 30 to display one of the plurality of image segments of each vertical column image sequentially. Afterwards, the color display 30 displays the next image segment of each vertical column image sequentially until the last image segment of each vertical column image. Then, a black-and-white/grayscale image is displayed completely.

Figure 5C:
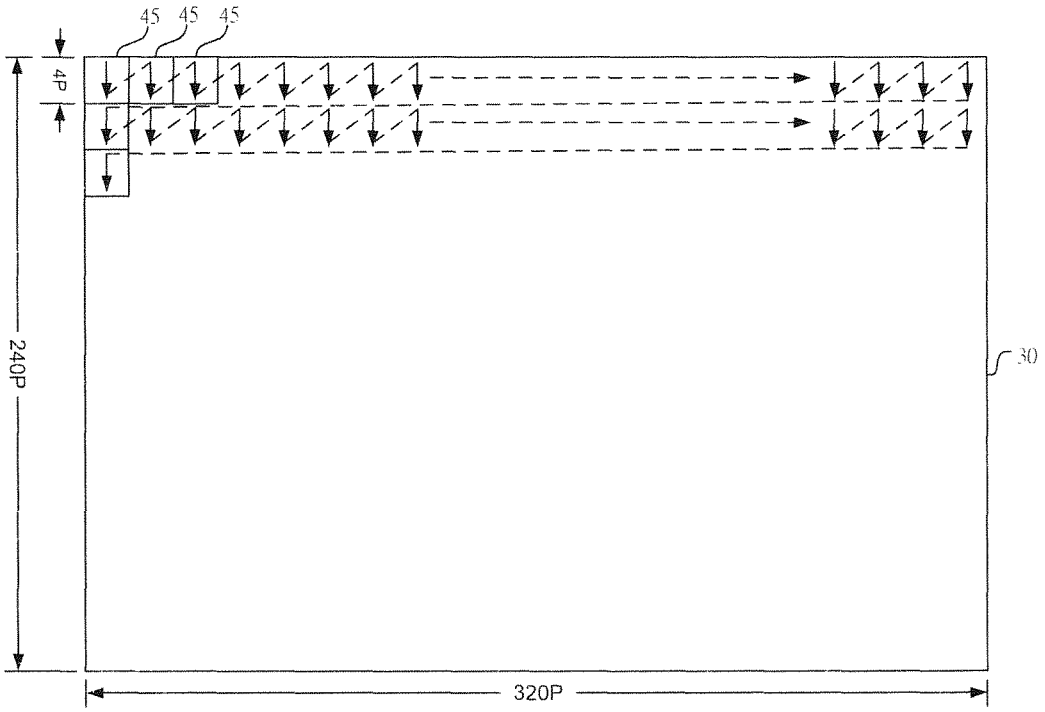
FIG. 5C shows a schematic diagram of a color display displaying a black-and-white/grayscale image according to the second embodiment of the present invention.

Please refer to FIG. 5C, which shows a schematic diagram of a color display displaying a black-and-white/grayscale image according to the second embodiment of the present invention. According to the present embodiment, because the format of the input data is 4-level gray scale, one byte of the input data contains 4 pixel data, which represent 4 black-and-white/grayscale pixels, as shown in FIG. 4A. The display parameter according to the present embodiment is the corresponding parameter for 4-level gray scale. As shown in FIG. 5C, the driver 24, as shown in FIG. 1, drives the color display 30 to display each image segment of each vertical column image sequentially. According to the present embodiment, because one byte of the input data represents 4 black-and-white/grayscale pixels (4P), each image segment contains 4 black-and-white/gray scale pixels. Thereby, each vertical column image according to the present embodiment contains 60 image segments, which means that the driving circuit 20 drives the color display 30 to perform 60 horizontal scans for displaying a black-and-white/grayscale image.

Figure 5D:
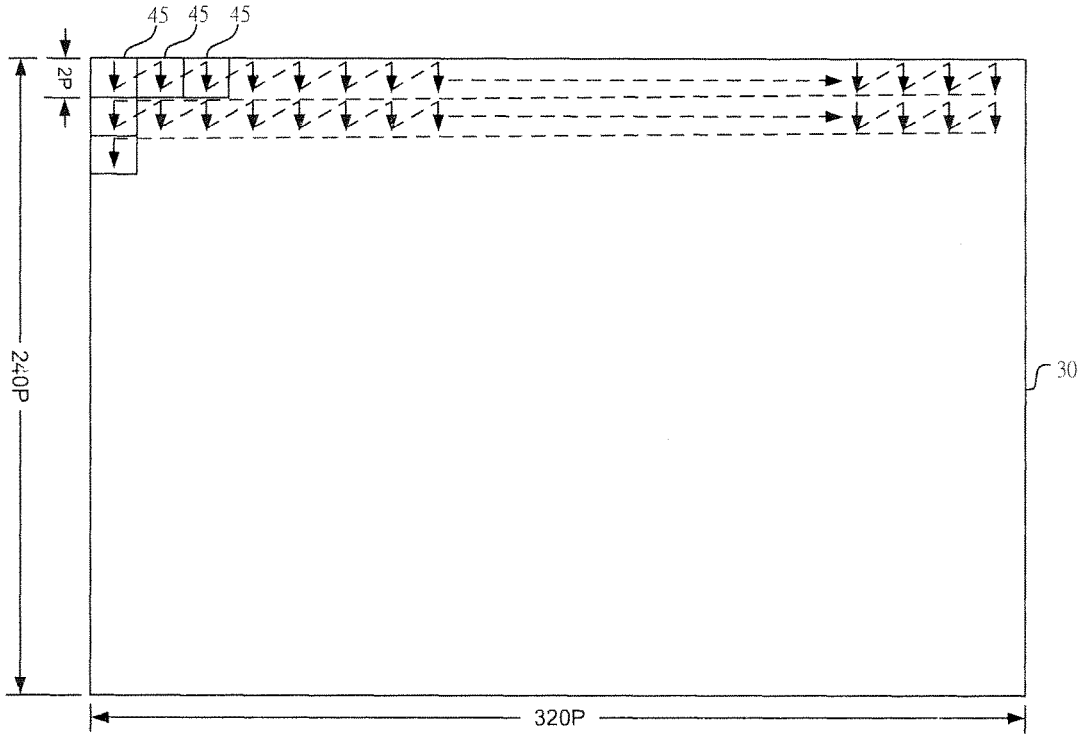
FIG. 5D shows a schematic diagram of a color display displaying a black-and-white/grayscale image according to the third embodiment of the present invention.

Please refer to FIG. 5D, which shows a schematic diagram of a color display displaying a black-and-white/grayscale image according to the third embodiment of the present invention. According to the present embodiment, because the format of the input data is 16-level gray scale, one byte of the input data contains 2 pixel data, which represent 2 black-and-white/grayscale pixels, as shown in FIG. 4A. The display parameter according to the present embodiment is the corresponding parameter for 16-level gray scale. As shown in FIG. 5D, the driver 24, as shown in FIG. 1, drives the color display 30 to display each image segment of each vertical column image sequentially. According to the present embodiment, each image segment contains 2 black-and-white/gray scale pixels (2P). Thereby, each vertical column image according to the present embodiment contains 120 image segments, which means that the driving circuit 20 drives the color display 30 to perform 120 horizontal scans for displaying a black-and-white/grayscale image.

Figure 5E:
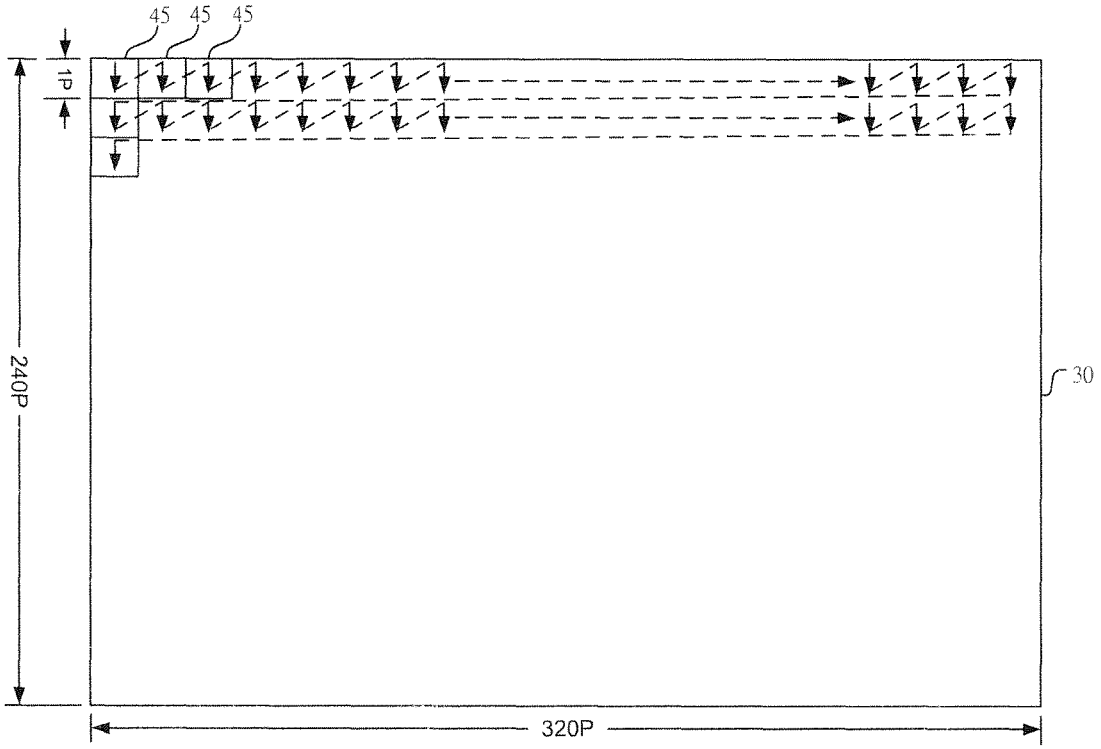
FIG. 5E shows a schematic diagram of a color display displaying a black-and-white/grayscale image according to the fourth embodiment of the present invention.

Please refer to FIG. 5E, which shows a schematic diagram of a color display displaying a black-and-white/grayscale image according to the fourth embodiment of the present invention. According to the present embodiment, because the format of the input data is 256-level gray scale, one byte of the input data represents one black-and-white/grayscale pixel, as shown in FIG. 4A. The display parameter according to the present embodiment is the corresponding parameter for 256-level gray scale. As shown in FIG. 5E, the color display 30 displays each image segment of each vertical column image sequentially. According to the present embodiment, each image segment contains one black-and-white/gray scale pixel (1P). Thereby, the color display 30 performs 240 horizontal scans for displaying a black-and-white/grayscale image.

To sum up, the driving circuit and the data conversion circuit according to the present invention are used for converting black-and-white/grayscale input data and producing color output data. The driving circuit according to the present invention requires o high-transmission-rate microprocessor for transmitting color input data. The microprocessor in the driving circuit according to the present invention only needs to transmit black-and-white/grayscale input data to the driving circuit then the driving circuit can produce color output data for driving a color display to display a black-and-white/grayscale image.

Accordingly, the present invention conforms to the legal requirements owing to its novelty, nonobviousness, and utility. However, the foregoing description is only embodiments of the present invention, not used to limit the scope and range of the present invention. Those equivalent changes or modifications made according to the shape, structure, feature, or spirit described in the claims of the present invention are included in the appended claims of the present invention.

The invention claimed is:

1. A driving circuit for driving a color display to display black-and-white/grayscale images, comprising:

a data conversion circuit, receiving an input data transmitted by a microprocessor, the format of said input data being a black-and-white/grayscale format, said input data corresponding to a black-and-white/grayscale image, said data conversion circuit converting and separating said input data according to a format selecting signal for producing an output data, the format of said output data being a color format, a number of bits of said input data being less than that of said output data; and a driver, receiving said output data, and driving said color display to display said black-and-white/grayscale image according to said output data;

wherein said data conversion circuit receiving and separating said input data for outputting a plurality of basic pixel data, and the format of said plurality of basic pixel data being a black-arid-white/grayscale format, and said data conversion circuit receiving said plurality of basic pixel data, producing said output data according to said plurality of basic pixel data, said output data comprising a plurality of display pixel data, the format of said plurality of display pixel data being said color format, the number of bits of each of said display pixel data being greater than that of each of said basic pixel data, and said color display displaying a plurality of black-and-white/grayscale pixels according to said plurality of display pixel data of said output data;

a clock generator, generating a clock signal, and a plurality of pulses of said clock signal corresponding to said plurality of display pixel data of said output data;

wherein said format selecting signal represents a gray scale of said input data.

2. The driving circuit of claim 1, wherein each of said display pixel data corresponds to each of said basic pixel data, respectively; each of said display pixel data comprises a plurality of color data, respectively; and said data conversion circuit reproduces each of said basic pixel data for producing said plurality of color data of each of said display pixel data.

3. The driving circuit of claim 1, wherein said driver drives said color display to display said black-and-white/grayscale image according to a display parameter; said driver determines the order by which said color display displays a plurality of black-and-white/grayscale pixels of said black-and-white/grayscale image according to said display parameter; said black-and-white/grayscale image includes a plurality of vertical column images; each vertical column image includes a plurality of image segments; each of said image segments contains Q black-and-white/grayscale pixels with Q being greater or equal to one; said driver drives said color display to display one of said plurality of image segments of each vertical column image sequentially; and said color display continues to display the next image segment of each vertical column image.

4. The driving circuit of claim 1, wherein said microprocessor is a low-end microprocessor; said data conversion circuit generates a clock signal in response to a first clock signal.

5. A data conversion circuit of a driving circuit, comprising:

a conversion circuit, receiving an input data transmitted by a microprocessor, the format of said input data being a black-and-white/grayscale format, said input data corresponding to a black-and-white/grayscale image, said conversion circuit receiving and separating said input data according to a format selecting signal for outputting a plurality of basic pixel data, and the format of said plurality of basic pixel data being said black-and-white/grayscale format, wherein said format selecting signal represents a gray scale of said input data, and said conversion circuit receiving said plurality of basic pixel data, producing an output data for a color display according to said plurality of basic pixel data, the format of said output data being a color format, said output data comprising a plurality of display pixel data, the format of said plurality of display pixel data being said color format, and a number of bits of each of said display pixel data being greater than that of each of said basic pixel data; and a clock generator, generating a clock signal, and a plurality of pulses of said clock signal corresponding to said plurality of display pixel data of said output data;

wherein said color display displays a plurality of black-and-white/grayscale pixels according to said plurality of display pixel data of said output data for displaying said black-and-white/grayscale image.

6. The data conversion circuit of claim 5, wherein each of said display pixel data corresponds to each of said basic pixel data, respectively; each of said display pixel data comprises a plurality of color data, respectively; and said conversion circuit reproduces each of said basic pixel data for producing said plurality of color data of each of said display pixel data.

7. The data conversion circuit of claim 5, wherein said microprocessor is a low-end microprocessor; said input data is separated into said plurality of basic pixel data before said driving circuit produces said output data.

8. The driving circuit of claim 1, wherein said data conversion circuit separates said input data in accordance with a clock signal during the operation of said data conversion circuit.

* * * * *